US009109454B2

(12) United States Patent
Ellis et al.

(10) Patent No.: US 9,109,454 B2
(45) Date of Patent: Aug. 18, 2015

(54) TURBINE BUCKET WITH PRESSURE SIDE COOLING

(75) Inventors: Scott Edmond Ellis, Simpsonville, SC (US); Randall Richard Good, Simpsonville, SC (US); Bradley Taylor Boyer, Greenville, SC (US); Aaron Ezekiel Smith, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 730 days.

(21) Appl. No.: 13/409,341

(22) Filed: Mar. 1, 2012

(65) Prior Publication Data

US 2013/0230394 A1 Sep. 5, 2013

(51) Int. Cl.
*F01D 5/18* (2006.01)

(52) U.S. Cl.
CPC ..... *F01D 5/187* (2013.01); *F05D 2240/81* (2013.01); *F05D 2250/185* (2013.01)

(58) Field of Classification Search
CPC ..... F01D 5/18; F01D 5/186; F01D 5/187; F05D 2240/81; F05D 2250/185
USPC ..... 415/115; 416/95, 96 R, 97 R, 193 R, 416/193 A
See application file for complete search history.

(56) References Cited

U.S. PATENT DOCUMENTS

| | | | | |
|---|---|---|---|---|
| 3,849,025 | A | 11/1974 | Grondahl | |
| 5,340,278 | A | 8/1994 | Magowan | |
| 5,344,283 | A | 9/1994 | Magowan et al. | |
| 5,382,135 | A | 1/1995 | Green | |
| 5,545,002 | A * | 8/1996 | Bourguignon et al. | 415/115 |
| 5,848,876 | A | 12/1998 | Tomita | |
| 6,017,189 | A * | 1/2000 | Judet et al. | 416/97 R |
| 6,071,075 | A | 6/2000 | Tomita et al. | |
| 6,190,130 | B1 | 2/2001 | Fukue et al. | |
| 6,341,939 | B1 | 1/2002 | Lee | |
| 6,390,774 | B1 | 5/2002 | Lewis et al. | |
| 6,481,967 | B2 | 11/2002 | Tomita et al. | |
| 6,945,749 | B2 * | 9/2005 | De Cardenas | 415/115 |
| 7,147,439 | B2 | 12/2006 | Jacala et al. | |
| 7,255,536 | B2 | 8/2007 | Cunha et al. | |
| 7,416,391 | B2 * | 8/2008 | Veltre et al. | 416/97 R |
| 7,597,536 | B1 | 10/2009 | Liang | |
| 7,766,606 | B2 | 8/2010 | Liang | |
| 7,780,414 | B1 * | 8/2010 | Liang | 416/97 R |
| 8,444,381 | B2 * | 5/2013 | Seely | 416/1 |

(Continued)

FOREIGN PATENT DOCUMENTS

| | | | |
|---|---|---|---|
| EP | 1122405 | A2 | 8/2001 |
| EP | 1826360 | A2 | 8/2007 |
| EP | 2372086 | A2 | 10/2011 |

OTHER PUBLICATIONS

U.S. Appl. No. 12/878,075, filed Sep. 9, 2010, Boyer.

(Continued)

*Primary Examiner* — Nathaniel Wiehe
*Assistant Examiner* — Kayla McCaffrey
(74) *Attorney, Agent, or Firm* — Sutherland Asbill & Brennan LLP

(57) ABSTRACT

A turbine bucket for use with a gas turbine engine, as described herein, may include a platform, an airfoil extending from the platform, and a number of cooling circuits extending through the platform and the airfoil. One of the cooling circuits may be a serpentine cooling channel positioned within the platform.

13 Claims, 3 Drawing Sheets

(56) References Cited

U.S. PATENT DOCUMENTS

| | | | | |
|---|---|---|---|---|
| 2006/0056970 | A1 | 3/2006 | Jacala et al. | |
| 2007/0189896 | A1 | 8/2007 | Itzel et al. | |
| 2010/0129213 | A1 | 5/2010 | Strohl et al. | |
| 2011/0123310 | A1 | 5/2011 | Beattie et al. | |
| 2011/0223004 | A1* | 9/2011 | Lacy et al. | 415/115 |
| 2012/0034102 | A1 | 2/2012 | Boyer | |

OTHER PUBLICATIONS

U.S. Appl. No. 12/972,835, filed Dec. 20, 2010, Harris, Jr., et al.
Search Report and Written Opinion from EP Application No. 13157090.5 dated May 16, 2013.

* cited by examiner

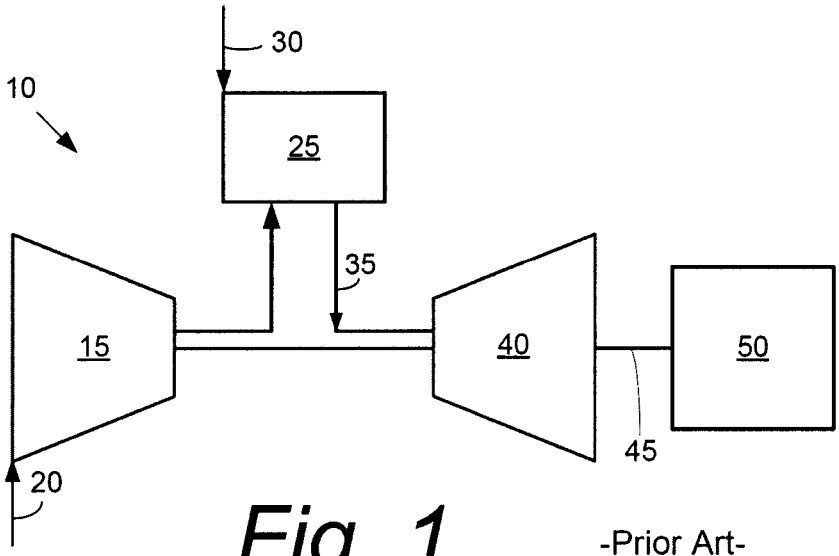
Fig. 1 -Prior Art-
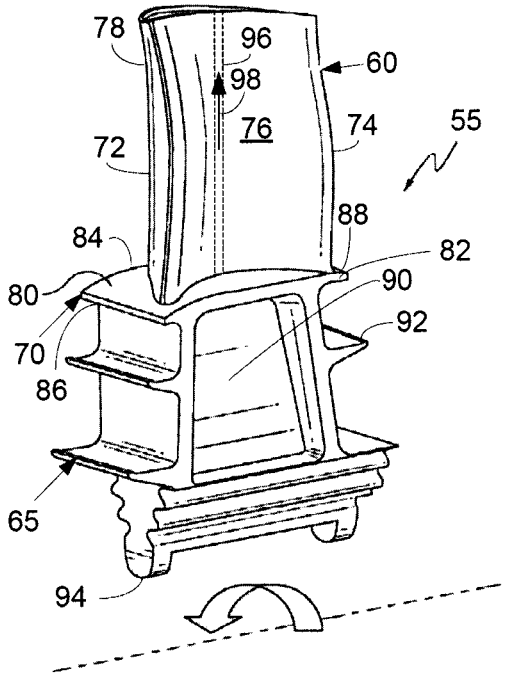
-Prior Art-
Fig. 2

TURBINE BUCKET WITH PRESSURE SIDE COOLING

TECHNICAL FIELD

The present disclosure relates generally to gas turbine engines and more particularly relate to a gas turbine engine with a turbine bucket having pressure side platform cooling via a serpentine cooling channel extending therethrough with film cooling holes.

BACKGROUND OF THE INVENTION

Known gas turbine engines generally include rows of circumferentially spaced nozzles and buckets. A turbine bucket generally includes an airfoil having a pressure side and a suction side and extending radially upward from a platform. A hollow shank portion may extend radially downward from the platform and may include a dovetail and the like so as to secure the turbine bucket to a turbine wheel. The platform generally defines an inner boundary for the hot combustion gases flowing through a gas path. As such, the platform may be an area of high stress concentrations due to the hot combustion gases and the mechanical loading thereon. In order to relieve a portion of the thermally induced stresses, a turbine bucket may include some type of platform cooling scheme or other arrangements so as to reduce the temperature differential between the top and the bottom of the platform.

Various types of platform cooling arrangements are known. For example, a number of film cooling holes may be defined in the turbine bucket between the shank portion and the platform. Cooling air may be introduced into a hollow cavity of the shank portion and then may be directed through the film cooling holes to cool the platform in the localized region of the holes. Another known cooling arrangement includes the use of a cored platform. The platform may define a cavity through which a cooling medium may be supplied. These known cooling arrangements, however, may be difficult and expensive to manufacture and may require the use of an excessive amount of air or other type of cooling medium.

There is therefore a desire for an improved turbine bucket for use with a gas turbine engine. Preferably such a turbine bucket may provide cooling to the platform and other components thereof without excessive manufacturing and operating costs and without excessive cooling medium losses for efficient operation and an extended component lifetime.

SUMMARY OF THE INVENTION

The present disclosure thus provides a turbine bucket for use with a gas turbine engine. The turbine bucket may include a platform, an airfoil extending from the platform, and a number of cooling circuits extending through the platform and the airfoil. One of the cooling circuits may be a serpentine cooling channel positioned within the platform.

The present disclosure further provides a method of cooling a platform of a turbine bucket. The method may include the steps of positioning a serpentine cooling channel within the platform, feeding a cooling medium to the serpentine cooling channel via a single input, flowing the cooling medium through the serpentine cooling channel, and flowing the cooling medium to a top surface of the platform from the serpentine cooling channel via a number of film cooling holes positioned therein.

The present disclosure further provides a turbine bucket for use with a gas turbine engine. The turbine bucket may include a platform, an airfoil extending from the platform, and a serpentine cooling channel positioned within the platform. The serpentine cooling channel may extend from a cooling feed input to a number of film cooling holes.

These and other features and advantages of the present disclosure will become apparent to one of ordinary skill in the art upon review of the following detailed description when taken in conjunction with the several drawings and the appended claims.

BRIEF DESCRIPTION OF THE DRAWINGS

FIG. 1 is a schematic diagram of a gas turbine engine with a compressor, a combustor, and a turbine.

FIG. 2 is a perspective view of a known turbine bucket.

DETAILED DESCRIPTION

Figure 3:
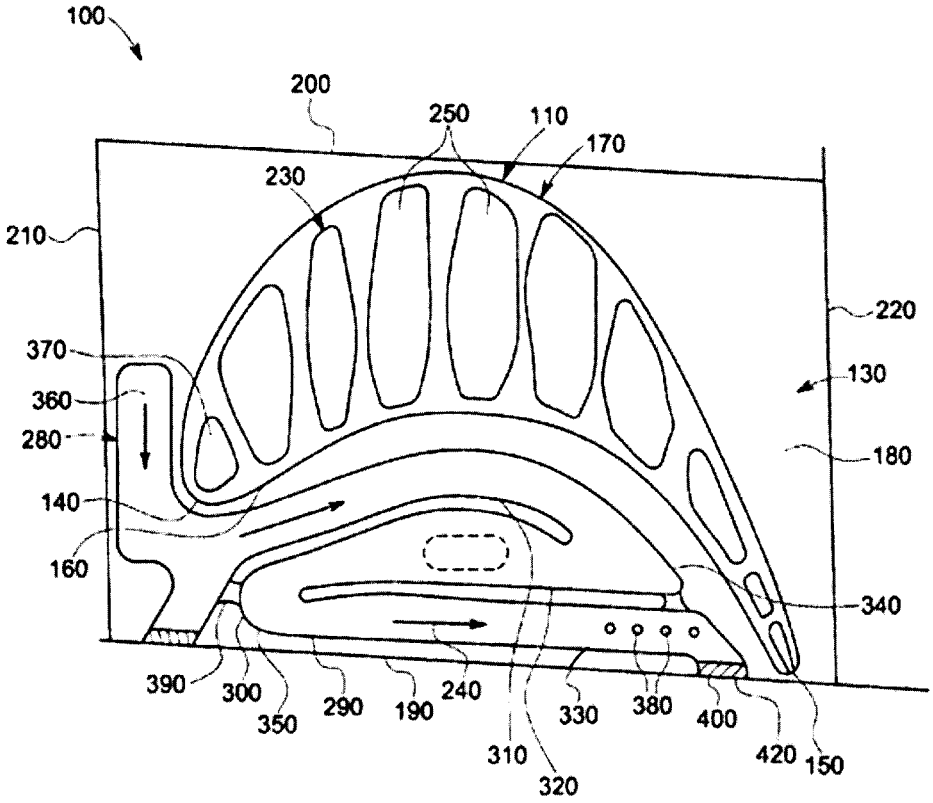
FIG. 3 is a top plan view of a turbine bucket with a platform having a serpentine cooling channel as may be described herein.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

FIG. 2 shows an example of a turbine bucket 55 that may be used with the turbine 40. Generally described, the turbine bucket 55 includes an airfoil 60, a shank portion 65, and a platform 70 disposed between the airfoil 60 and the shank portion 65. The airfoil 60 generally extends radially upward from the platform 70 and includes a leading edge 72 and a trailing edge 74. The airfoil 60 also may include a concave wall defining a pressure side 76 and a convex wall defining a suction side 78. The platform 70 may be substantially horizontal and planar. Likewise, the platform 70 may include a top surface 80, a pressure face 82, a suction face 84, a forward face 86, and an aft face 88. The top surface 80 of the platform 70 may be exposed to the flow of the hot combustion gases 35. The shank portion 65 may extend radially downward from the platform 70 such that the platform 70 generally defines an interface between the airfoil 60 and the shank portion 65. The shank portion 65 may include a shank cavity 90 therein. The shank portion 65 also may include one or more angle wings 92 and a root structure 94 such as a dovetail and the like. The root structure 94 may be configured to secure the turbine bucket 55 to the shaft 45. Other components and other configurations may be used herein.

The turbine bucket 55 may include one or more cooling circuits 96 extending therethrough for flowing a cooling medium 98 such as air from the compressor 15 or from another source. The cooling circuits 96 and the cooling medium 98 may circulate at least through portions of the airfoil 60, the shank portion 65, and the platform 70 in any order, direction, or route. Many different types of cooling circuits and cooling mediums may be used herein. Other components and other configurations also may be used herein.

Figure 4:
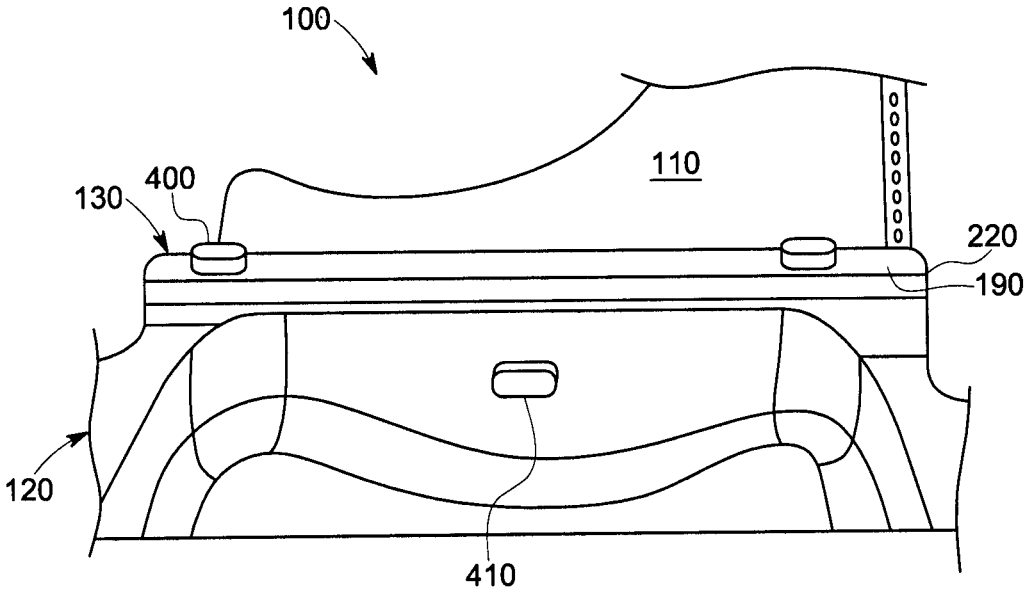
FIG. 4 is a bottom perspective view of a portion of the platform of the turbine bucket of FIG. 3.
Figure 5:
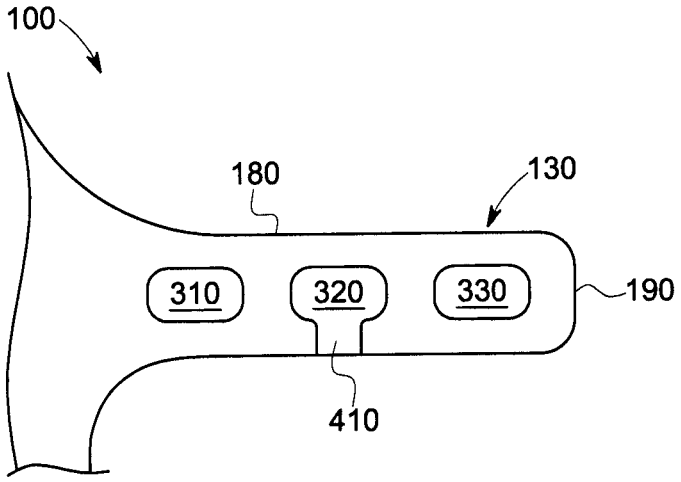
FIG. 5 is a side cross-sectional view of a portion of the platform of the turbine bucket of FIG. 3.

FIGS. 3-5 show an example of a turbine bucket 100 as may be described herein. The turbine bucket 100 may include an airfoil 110, a shank portion 120, and a platform 130. Similar to that described above, the airfoil 110 extends radially upward from the platform 130 and includes a leading edge 140 and a trailing edge 150. The airfoil 110 also includes a pressure side 160 and a suction side 170. The platform 130 may include a top surface 180, a pressure face 190, a suction face 200, a forward face 210, and an aft face 220. The top surface 180 of the platform 130 may be exposed to the flow of the hot combustion gases 35. The shank portion 120 also may include one or more angle wings and a root structure similar to that described above. Other components and other configurations may be used herein.

The turbine bucket 100 also may have one or more cooling circuits 230 extending therein. The cooling circuits 230 serve to cool the turbine bucket 100 and the components thereof with a cooling medium 240 therein. Any type of cooling medium 240 such as air, steam, and the like may be used herein from any source. The cooling circuits 230 may extend through the airfoil 110, the shank portion 120, and the platform 130 in any order, direction, or route. In this example, the cooling circuits 230 may include a number of airfoil cooling channels 250 extending through the airfoil 110. The cooling circuits 230 also may include one or more edge cooling channels extending through the platform 130 and elsewhere. The cooling circuits 230 may have any size, shape, and orientation. Any number of the cooling circuits 230 may be used herein. Other components and other configurations may be used herein.

The cooling circuits 230 also may include a serpentine cooling channel 280 positioned within the platform 130. The serpentine cooling channel 280 may be positioned about the pressure side 160 of the airfoil 110 between the airfoil 110 and the pressure face 190 of the platform 130. The serpentine cooling channel 280 may include a number of legs 290 with a number of bends 300 in-between so as to form the serpentine shape. In this example, a first leg 310, a second leg 320, and a third leg 330 may be used with a first bend 340 and a second bend 350 therebetween. Any number of the legs 290 and the bends 300 may be used herein in any configuration. The serpentine cooling channel 280 may extend along the platform 130 in any direction from the airfoil 110 to the pressure face 190 and from the forward face 210 to the aft face 220. Although multiple serpentine cooling channels 280 may be used, a single channel 280 is shown herein. Other components and other configurations may be used herein.

The serpentine cooling channel 280 may extend from a cooling feed input 360. The cooling feed input 360 may be in communication with one of the airfoil cooling channels 250, such as airfoil cooling channel 370. Although a single cooling feed input 360 generally will be used, multiple cooling feed inputs 360 also may be used herein. One or more of the legs 290 may have a number of film cooling holes 380 extending to the top surface 180 of the platform 130. The number, size, and configuration of the film cooling holes 380 may be varied so as to optimize cooling performance. The cooling medium 240 thus may enter the serpentine cooling channel 280 via the cooling feed input 360 and exit via the film cooling channels 250 so as to cool the top surface 180 of the platform 130 or elsewhere as required. Other components and other configurations may be used herein.

The serpentine cooling channel 280 may be formed within the platform 130 by any suitable means. For example, the serpentine cooling channel 280 may be formed by an electrical discharge machining ("EDM") process or by a casting process. The serpentine cooling channel 280 also may be formed by a curved shaped-tube electrolytic machining ("STEM") process. Generally described, the STEM process utilizes a curved stem electrode operatively connected to a rotational driver. Other types of manufacturing processes may be used herein. In order to aid in the manufacturing process, a number of core ties 390 may be used to provide for inspection and repair access. The core ties 390 may be brazed shut. Likewise, a number of slash face printouts 400 and/or bottom core printouts 410 may be enclosed with a plug 420 and the like. Other components and other configurations may be used herein.

In use, the cooling medium 240 may extend through the airfoil cooling channels 250 of the cooling circuits 230 of the turbine bucket 100. The cooling medium 240 may be in communication with the serpentine cooling channel 280 via the cooling feed input 360 and one of the airfoil cooling channels 250. The cooling medium 240 may flow through the legs 290 and the bends 300 of the serpentine cooling channel 280 and exit via the film cooling holes 380. The cooling medium 240 thus may cool the top surface 180 of the pressure side of the platform 130 that may be in the flow path of the hot combustion gases 35.

Cooling of the platform 130 via the serpentine cooling channel 280 thus may improve the overall operating lifetime of the turbine bucket 100. Specifically, cooling the platform 130 may avoid distress such as oxidation and fatigue that may be created therein due to the high temperatures of the hot combustion gases 35. The turbine bucket 100 described herein thus may operate at longer intervals. Because the serpentine cooling channel 280 generally has only one cooling input 360, overall manufacturing complexity may be reduced. Moreover, the serpentine cooling channel 280 may be efficient given this direct access to the core cooling circuits 230. Positions other than the platform 130 also may be used herein. Alternatively, the cooling medium also may be discharged about the pressure face 190 so as to keep the edge of the bucket 100 cool as well as cooling an adjacent bucket 100.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A turbine bucket for use with a gas turbine engine, comprising:

a platform;

an airfoil extending from the platform; and a plurality of cooling circuits extending through the platform and the airfoil;

wherein one of the plurality of cooling circuits comprises one or more airfoil cooling channels within the airfoil and a serpentine cooling channel within the platform;

wherein the serpentine cooling channel comprises a cooling feed input configured to receive cooling air from a single one of the airfoil cooling channels and a plurality of film cooling holes configured to exhaust the cooling air to a top surface of the platform, such that the cooling air is exhausted at a pressure side of the airfoil, the cooling feed input forming a first cooling path portion extending adjacent to an edge of the platform, such that an end of the cooling feed input leads to an outlet of the platform and corresponds to a start of a second cooling path portion comprising a first leg, a second leg, and a third leg.

2. The turbine bucket of claim 1, wherein the platform comprises a pressure face and wherein the serpentine cooling channel extends within the platform from about the airfoil to the pressure face.

3. The turbine bucket of claim 1, wherein the platform comprises a forward face and an aft face and wherein the serpentine cooling channel extends within the platform from about the forward face to the aft face.

4. The turbine bucket of claim 1, wherein the serpentine cooling channel extends within the platform under the top surface.

5. The turbine bucket of claim 1, wherein the serpentine cooling channel comprises one or more bends.

6. The turbine bucket of claim 5, wherein the serpentine cooling circuit comprises a first bend and a second bend.

7. The turbine bucket of claim 1, wherein the platform comprises at least two printouts disposed within a slashface of the platform.

8. A method of cooling a platform of a turbine bucket, comprising:

positioning a serpentine cooling channel within the platform, wherein the serpentine cooling channel comprises a cooling feed input configured to receive cooling air from a single airfoil cooling channel, the cooling feed input forming a first cooling path portion extending adjacent to an edge of the platform, such that an end of the cooling feed input leads to an outlet of the platform and corresponds to a start of a second cooling path portion comprising a first leg, a second leg, and a third leg;

feeding a cooling medium to the serpentine cooling channel via the cooling feed input;

flowing the cooling medium through the serpentine cooling channel by flowing the cooling medium through each of the respective legs and one or more bends within the serpentine cooling channel; and flowing the cooling medium to a top surface of the platform from the serpentine cooling channel via a plurality of film cooling holes.

9. The method of claim 8, wherein the step of positioning a serpentine cooling channel within the platform comprises casting or machining the serpentine cooling channel therein.

10. A turbine bucket for use with a gas turbine engine, comprising:

a platform;

an airfoil extending from the platform, the airfoil comprising one or more airfoil cooling channels therein; and a serpentine cooling channel positioned within the platform, the serpentine cooling channel comprising a plurality of film cooling holes configured to exhaust the cooling air to a top surface of the platform, such that the cooling air is exhausted at a pressure side of the airfoil;

wherein the serpentine cooling channel extends from a cooling feed input to a plurality of film cooling holes, the cooling feed input forming a first cooling path portion extending adjacent to an edge of the platform, such that an end of the cooling feed input leads to an outlet of the platform and corresponds to a start of a second cooling path portion comprising a first leg, a second leg, and a third leg; and the serpentine cooling channel receives cooling air at the cooling feed input from a single one of the airfoil cooling channels.

11. The turbine bucket of claim 10, wherein the platform comprises a pressure face and wherein the serpentine cooling channel extends within the platform from about the airfoil to the pressure face.

12. The turbine bucket of claim 10, wherein the platform comprises a forward face and an aft face and wherein the serpentine cooling channel extends within the platform from about the forward face to the aft face.

13. The turbine bucket of claim 10, wherein the serpentine cooling channel comprises one or more bends.

* * * * *